US005616036A

United States Patent [19]

Polidori

[11] Patent Number: 5,616,036

[45] Date of Patent: Apr. 1, 1997

[54] GROUNDING CLAMP

[75] Inventor: Mario Polidori, Medford Lakes, N.J.

[73] Assignee: Thomas Polidori, Medford, N.J.

[21] Appl. No.: 549,429

[22] Filed: Oct. 27, 1995

[51] Int. Cl.[6] ..... H01R 4/66

[52] U.S. Cl. ..... 439/100; 439/800; 248/74.1

[58] Field of Search ..... 439/98, 100, 833, 439/839, 792, 800; 246/74.1, 74.2

[56] References Cited

U.S. PATENT DOCUMENTS

| | | | |
|---|---|---|---|
| 2,279,866 | 4/1942 | Ellinwood | 174/40 |
| 2,292,320 | 8/1942 | Hammerly | 439/833 |
| 2,338,006 | 12/1943 | Morehouse | 248/74 |
| 2,422,589 | 6/1947 | Samzelins | 439/833 |
| 2,618,450 | 11/1952 | Thomas | 248/74 |
| 2,982,505 | 5/1961 | Shy | 248/74 |
| 3,159,708 | 12/1964 | Deal | 174/40 |
| 3,295,806 | 1/1967 | Modeme | 248/74 |
| 3,594,682 | 7/1971 | Oleson | 439/100 |
| 4,097,114 | 6/1978 | Motten | 439/833 |
| 4,472,018 | 9/1984 | Urani | 439/833 |
| 4,875,864 | 10/1989 | Campbell | 439/100 |

FOREIGN PATENT DOCUMENTS

| | | |
|---|---|---|
| 197882 | 5/1958 | Australia . |

*Primary Examiner*—Neil Abrams
*Assistant Examiner*—T. C. Patel
*Attorney, Agent, or Firm*—Norman E. Lehrer

[57] ABSTRACT

A grounding clamp for securing an electrical device to a riser pipe comprises a substantially C-shaped resilient inner segment. The inner segment has an inside surface, an outside surface, a first end and a second end. A grounding cable, which is in electrical contact with the inner segment, extends therefrom. A cam compresses the inside surface of the inner segment around the circumference of the pipe.

4 Claims, 1 Drawing Sheet

GROUNDING CLAMP

BACKGROUND OF THE INVENTION

The present invention is directed toward a grounding clamp for securement to an object and, more particularly, to such a clamp that can readily and firmly secure an electrical device to a riser pipe.

Riser pipes are typically installed in the ground next to electrical devices, e.g. transformers, that carry large currents. Many different types of grounding clamps have been developed to connect electrical devices to the riser pipe in order to provide a proper ground for the electrical devices. More specifically, the grounding clamp is fastened around the riser pipe. The electrical device is secured to the grounding clamp by means of an electrically conductive cable that has one end secured to the clamp and an opposite end secured to the electrical device.

A problem with many existing grounding clamps is only a limited surface area of the grounding clamp contacts the riser pipe. Accordingly, if a power surge is created in the electrical device only a limited amount of the electrical current will travel from the electrical device, through the grounding clamp, down the riser pipe and into the ground where it can be safely dissipated.

Other grounding clamps are not firmly secured to the riser pipe. Accordingly, if a power surge is created in the electrical device and the grounding clamp is not in firm engagement with the riser pipe the electrical device can be destroyed or damage or injury can be caused to property or people in the vicinity.

SUMMARY OF THE INVENTION

The present invention is designed to overcome the deficiencies of the prior art discussed above. It is an object of the present invention to provide a grounding clamp that can firmly secure a grounding cable to an electrical device.

It is another object of the invention to provide such a clamp that makes substantial electrical contact with an object secured thereto.

In accordance with the illustrative embodiments, demonstrating features and advantages of the present invention, there is provided a grounding clamp for securing a grounding cable to a pipe. The clamp includes a substantially C-shaped resilient inner segment. The inner segment has an inside surface, an outside surface, a first end and a second end. A grounding cable, which is in electrical contact with the inner segment, extends therefrom. A cam compresses the inner segment around the circumference of the pipe.

Other objects, features and advantages will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
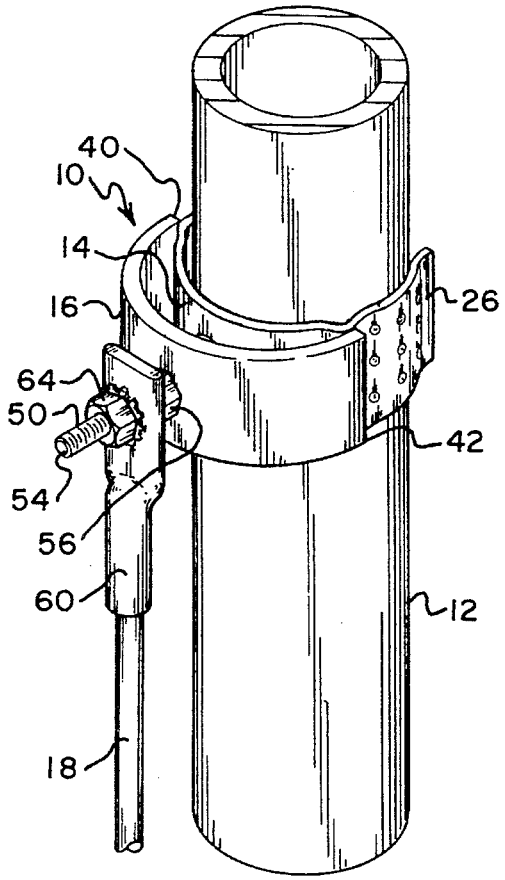
FIG. 1 is a perspective view of the present invention shown secured to a riser pipe.

Referring now to the drawings in detail wherein like reference numerals have been used throughout the various figures to designate like elements, there is shown in the FIGS. 1–4 a grounding clamp constructed in accordance with the principles of the present invention and designated generally as 10.

The grounding clamp 10 is adapted to be secured to a riser pipe 12 or the like and includes a substantially C-shaped resilient inner segment 14, a rigid outer segment 16 and a grounding cable 18.

The resilient inner segment 14 has an inside surface 20, an outside surface 22, a first end 24 and a second end 26. The first and second ends 24 and 26 are flared outwardly to facilitate the mounting of the grounding clamp 10 to the riser pipe 12 as more fully described below. A preferred material for the inner segment is stainless steel.

The inner segment 14 has a plurality of projections 28 that extend inwardly from the inside surface 20 thereof in order to increase the electrical contact between the grounding clamp 10 and the riser pipe 12. The projections 28 are formed by piercing the metal from which the inner segment 14 is made in order to create burr-like projections. The inner segment 14 has an opening 30 formed through the center thereof. Two spaced apart raised portions 32 and 34 extend outwardly from the outside surface 22 thereof.

The outer segment 16 has an outside surface 36, an inside surface 38, a first end 40 and a second end 42. Formed through the center of the outer segment 16 is an opening 44. The outer segment 16 and the inner segment 14 are connected to one another in the following manner. A screw 50 is threaded through the opening 30 in the inner segment 14 until the head 52 of the screw is positioned against the inside surface 20 of the inner segment. The opening 44 in the outer segment 16 is then positioned over the screw 50 so that the ends 40 and 42 of the outer segment 16 contact the raised portions 32 and 34 of the inner segment 14 (see FIG. 3). Thereafter, a nut 56 is threaded on the screw 50 to secure the inner segment 14 to the outer segment 16. The outer segment 16 is preferably comprised of a steel or other electrically conductive metal or metal alloy and is substantially more rigid than the resilient inner segment 14.

The grounding cable 18 has a lug connector 60 that extends upwardly from one end thereof. A hole 62 is formed through the lug connector 60. The grounding cable 18 is secured to the clamp 10 by positioning the hole 62 in the lug connector 60 over the screw 50. Nut 64 secures the lug connector 60 of the grounding cable against the outside surface 36 of the outer segment 16. The grounding cable has one end secured to an electrical device in order to provide a safe ground therefor.

Figure 3:
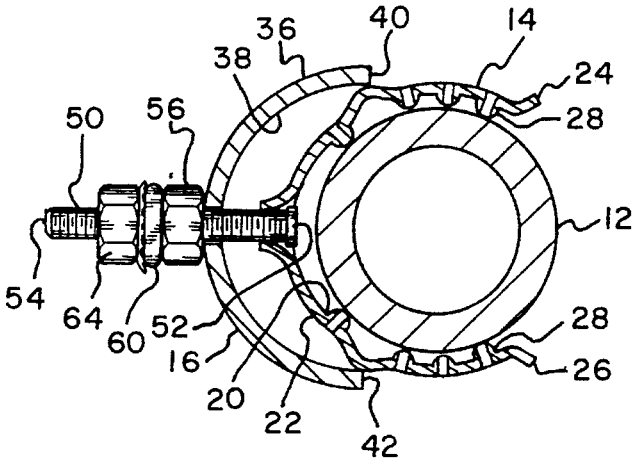
FIG. 3 is a top plan and partial cross-sectional view of the present invention shown prior to being secured to the riser pipe.
Figure 4:
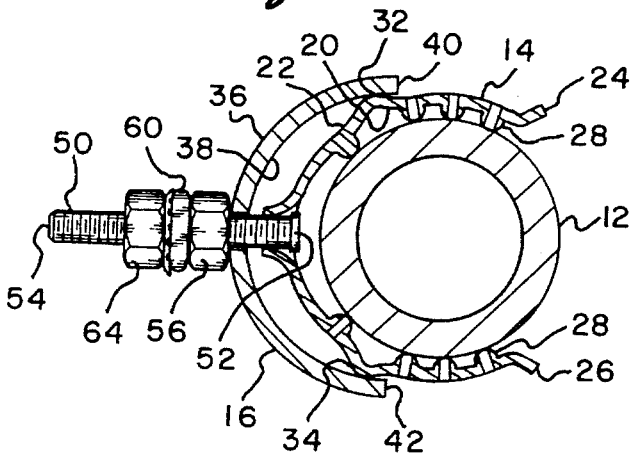
FIG. 4 is a view similar to FIG. 3 showing the clamp firmly secured to pipe.
Figure 2:
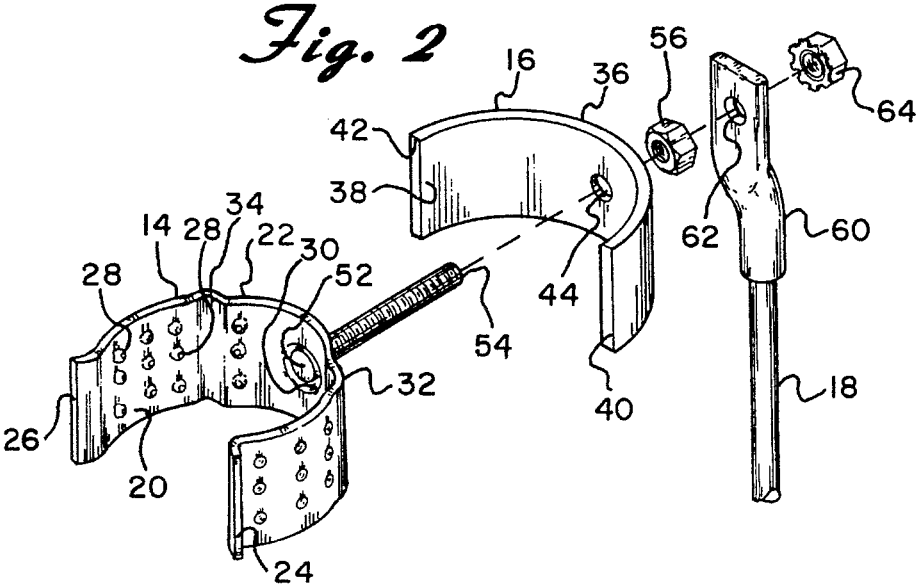
FIG. 2 is an exploded perspective view of the present invention.

In order to facilitate an understanding of the principles associated with the foregoing apparatus, its operation will now be briefly described. The grounding clamp 10 in the condition shown in FIG. 3 is secured to the riser pipe 12, which extends upwardly from the ground, by first positioning ends 24 and 26 of the inner segment 14 adjacent the pipe. Thereafter, the clamp is forced against the riser pipe so that the projections 28 that extend from the inside surface 20 of the inner segment 14 contact the riser pipe.

As the clamp is forced against the pipe, the ends 24 and 26 move initially slightly further apart. Thereafter, nut 56 is turned in order to cause the ends 40 and 42 of the outer segment 16 to move passed the raised portions 32 and 34, respectively, so that the outer segment 16 squeezes the C-shaped inner segment 14 together. Accordingly, the outer segment 16 acts as a cam and forces the burr-like projections 28 firmly against the riser pipe. This establishes a strong mechanical and electrical contact between the clamp 10 and the riser pipe 12. Thereafter, the grounding cable 18 is secured to a transformer or other electrical device so as to provide a safe ground potential for the same.

The present invention may be embodied in other specific forms without departing from the spirit or essential attributes thereof and accordingly reference should be made to the appended claims rather than to the foregoing specification as indicating the scope of the invention.

What is claimed is:

1. A grounding clamp for connecting an electrical device to a riser pipe comprising:

a substantially C-shaped resilient inner segment having a first end, a second end, an inside surface and an outside surface, said first and second ends of said inner segment being flared outwardly in order to facilitate the securement of said grounding clamp to said pipe;

means for securing a grounding cable to said inner segment, and camming means adapted to force said inside surface of said inner segment against said riser pipe, said camming means including an outer segment having a first end and a second end, means for connecting said outer segment to said inner segment, said outer segment being movable relative to said inner segment and said connecting means being adapted to cause said inner and outer segments to move relative to each other and to cause said outer segment to forcibly engage said outside surface of said inner segment.

2. The grounding clamp of claim 1 wherein said resilient inner segment has a plurality of projections extending outwardly from said inner surface thereof for increasing the electrical contact with said riser pipe.

3. The grounding clamp of claim 1 wherein said camming means further includes said inner segment having two spaced apart raised portions extending outwardly from said outer surface thereof, said outer segment being adapted to forcibly engage one of said spaced apart raised portions adjacent said first end thereof and said outer segment being adapted to forcibly engage the other of said raised portions adjacent said second end thereof.

4. The grounding clamp of claim 1 wherein said connecting means includes a screw positioned through said inner segment and through said outer segment and a nut secured around said screw adjacent said outer segment, said nut being adapted to contact said outer segment and cause the same to forcibly engage said inner segment.

* * * * *